US005918329A

United States Patent [19]

Huang

[11] Patent Number: 5,918,329

[45] Date of Patent: Jul. 6, 1999

[54] FOLDABLE BED DETACHABLY MOUNTED ONTO A CRIB

[75] Inventor: Li-Chu Chen Huang, Chiayi, Taiwan

[73] Assignee: Discover International Co., Ltd., Tortola, Virgin Islands (Br.)

[21] Appl. No.: 08/987,246

[22] Filed: Dec. 9, 1997

[51] Int. Cl.[6] ..... A47D 7/00; A47D 13/06

[52] U.S. Cl. ..... 5/93.1; 5/97; 5/98.1; 5/99.1; 5/507.1; 5/503.1

[58] Field of Search ..... 5/99.1, 98.1, 93.1, 5/93.2, 97, 503.1, 504.1, 507.1, 658

[56] References Cited

U.S. PATENT DOCUMENTS

| | | | |
|---|---|---|---|
| 1,340,338 | 5/1920 | Henderson | 5/503.1 |
| 2,536,731 | 1/1951 | Douglas | 5/507.1 X |
| 2,553,087 | 5/1951 | Hanson | 5/93.1 |
| 3,574,872 | 4/1971 | Mattila | 5/99.1 X |
| 3,644,947 | 2/1972 | Padera | 5/93.1 X |
| 3,735,430 | 5/1973 | Platz | 5/93.1 X |
| 4,967,432 | 11/1990 | Kujawski et al. | 5/99.1 X |
| 5,349,709 | 9/1994 | Cheng | 5/93.1 |
| 5,555,577 | 9/1996 | Volpe | 5/93.1 |
| 5,615,427 | 4/1997 | Huang | 5/99.1 |
| 5,778,465 | 7/1998 | Myers | 5/99.1 |

*Primary Examiner*—Michael F. Trettel
*Assistant Examiner*—Robert G. Santos
*Attorney, Agent, or Firm*—Bacon & Thomas

[57] ABSTRACT

A foldable bed which can be detachably mounted onto a crib has a foldable main frame and a foldable secondary frame pivotally connected with the main frame. The main frame is able to be detachably mounted onto the crib and the secondary frame is able to be detachably and pivotally mounted on top of the main frame. The secondary frame has a fabric mat fitted thereto, onto which a baby can be placed at a height convenient for changing of a diaper. When the folded bed in not in use, it is convenient for the user to dismount the foldable bed from the crib and fold it for storage.

3 Claims, 5 Drawing Sheets

FOLDABLE BED DETACHABLY MOUNTED ONTO A CRIB

FIELD OF THE INVENTION

The present invention generally relates to a foldable bed, and more particularly to a foldable bed which is detachably mounted onto a crib. The foldable bed generally is designed to have a shape and structure enabling a user to take care of a baby conveniently and easily.

BACKGROUND OF THE INVENTION

A conventional crib generally has a plurality of top supports, side supports and bottom supports, and a parent is able to place a baby within the crib to let the baby rest. However, when the parent is trying to change the baby's diaper, the parent has to bend over to pick up the baby resting at the bottom of the crib. Due to differences in height of people, it is sometimes difficult for some users, e.g., senior people or disabled individuals, to bend over and so they may even have to proceed the caring process for a baby on their knees. Therefore, if there is no side door provided to a crib, parents often need to pick the baby up and put it onto another bed to proceed the caring process, which is inconvenient and troublesome. To overcome the aforementioned problems, an inner bed is provided to the crib. The inner bed is composed of a rectangular frame with fabric attached thereto, such that the parent is able to place the baby onto the fabric to proceed the caring process, eliminating the trouble of carrying the baby to another location. Yet, this kind of inner bed which is securely mounted within a crib takes up a large space which is almost the same as the space of the crib itself. When the baby has grown, such that the inner bed is no longer required, storage of the inner bed is not convenient as it is not foldable.

From the previous description, it is noted that in order to have a handy foldable bed within a crib, an improvement to the conventional inner bed is thus required.

A foldable bed for a crib and constructed in accordance with the present invention tends to mitigate and/or obviate the aforementioned problems.

SUMMARY OF THE INVENTION

The main objective of the invention is to provide a foldable bed which can be fitted to a crib. The foldable bed includes a main frame and a secondary frame pivotally connected to the main frame. The main frame includes a first pair of retainers, a second pair of retainers respectively and opposingly mounted thereon and a pair of couplers opposingly and pivotally mounted thereon. Furthermore, at least one connector is mounted onto a side support of the main frame and has an inner side support of the secondary frame rotatably received therein. Therefore, the secondary frame is able to pivot relative to the main frame and the main frame is able to be folded through the couplers to reduce the storage space after the foldable bed is dismounted from the crib.

Other objects, advantages and novel features of the invention will become more apparent from the following detailed description when taken in conjunction with the accompanying tools.

BRIEF DESCRIPTION OF THE DRAWINGS

The present invention will now be better understood with reference to the following drawings, wherein.

DETAILED DESCRIPTION OF THE PREFERRED EMBODIMENT

Figure 1:
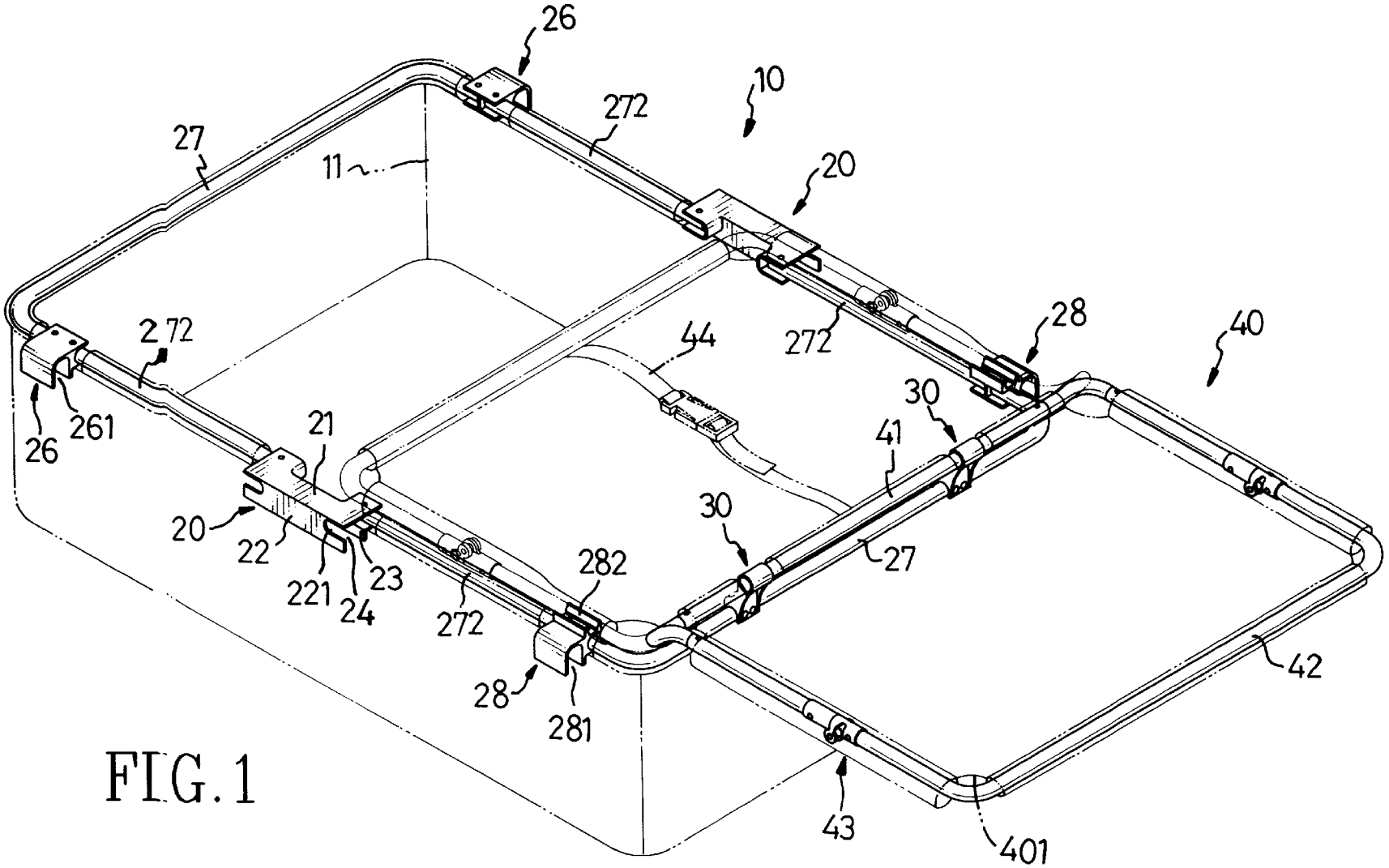
FIG. 1 is a perspective view of a preferred embodiment of a foldable bed for a crib and constructed in accordance with the present invention.
Figure 5:
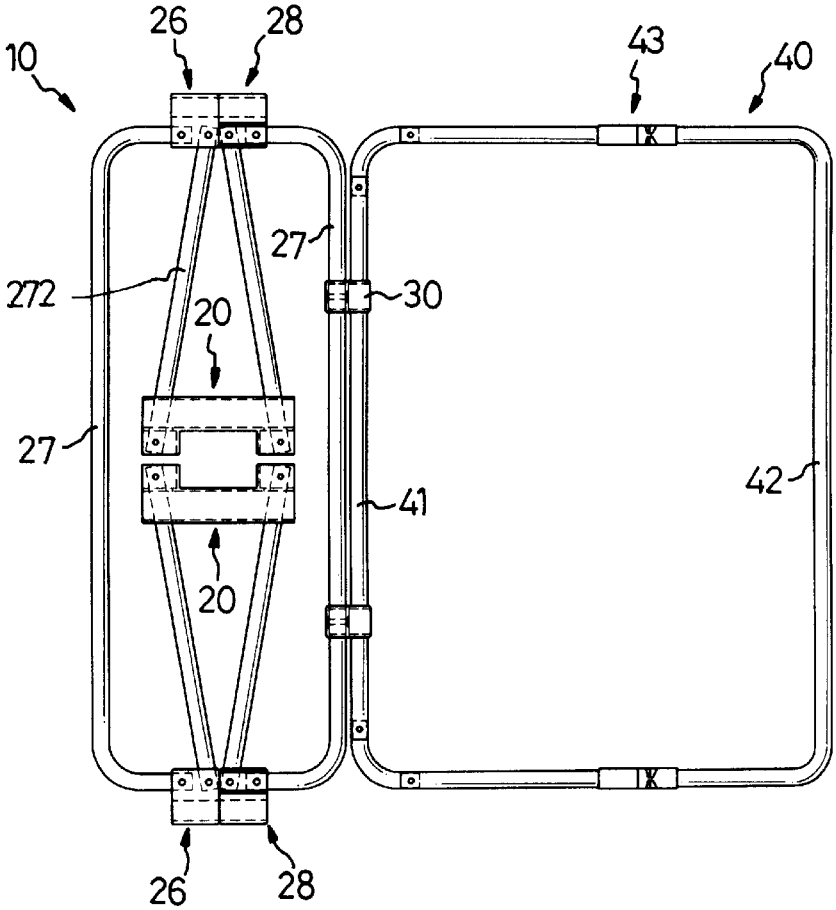
FIG. 5 is a schematic top view showing a folding operation of the foldable bed of the invention.

Referring to FIG. 1, a foldable bed comprising a main frame 10 having a fabric casing 11 securely attached thereto and a secondary frame 40 having a fabric mat 402 securely attached thereto is shown. It is to be noted that the main frame 10 has one pair of substantially U shaped and opposingly connected supports 27 which pivotally connect with each other by means of two couplers 20. The coupler 20 is configured to have a first side plate 22, a second side plate 23 and a top plate 21 extending therebetween. The first side plate 22 and the second side plate 23 are perpendicularly connected with the top plate 21 and extend downwardly, thereby defining therein a first space 24. Furthermore, the first side plate 22 defines therein two opposed cutouts 221, so that, as seen in FIG. 5, a first distal end of a leg 272 of the U shaped support 27 pivotally connected with the coupler 20 has enough room to pivot about the coupler 20 within the space 24. A pair of first connectors 26 are pivotally connected to a second distal end of the pair of the legs 272 of one of the U shaped supports 27. The first connector 26 defines therein a first U shaped recess 261. A pair of second connectors 28 are securely connected on a respective one of another pair of the legs 272. Each second connector 28 is provided with a second U shaped recess 281 and a third U shaped recess 282 reversely disposed to the second recess 281. On one side rod of one of the opposingly and pivotally connected U shaped supports 27, at least one joint 30 (two are shown in this embodiment) is fixedly mounted thereon for the insertion of a first U-shaped side rod 41 of the secondary frame 40. The secondary frame 40 is substantially rectangular in shape and is composed of the first U shaped side rod 41 and a second U shaped rod 42, whereas, the first U shaped rod 41 is pivotally connected with the second U shaped rod 42 to form a rectangle by means of two foldable devices 43. Furthermore, from the phantom line shown in FIG. 1, since the first U shaped rod 41 is pivotally received within the joint 30, the secondary frame 40 is able to be securely seated within the third U shaped recess 282 of the second connector 28 after the pivotal movement of the secondary frame 40. In addition, it is notable that after the secondary frame 40 is securely seated within the third U shaped recesses 282 of the second connector 28, a belt 44 is seen to be provided on a face of the fabric mat 401 securely sewed onto the secondary frame 40.

Figure 2:
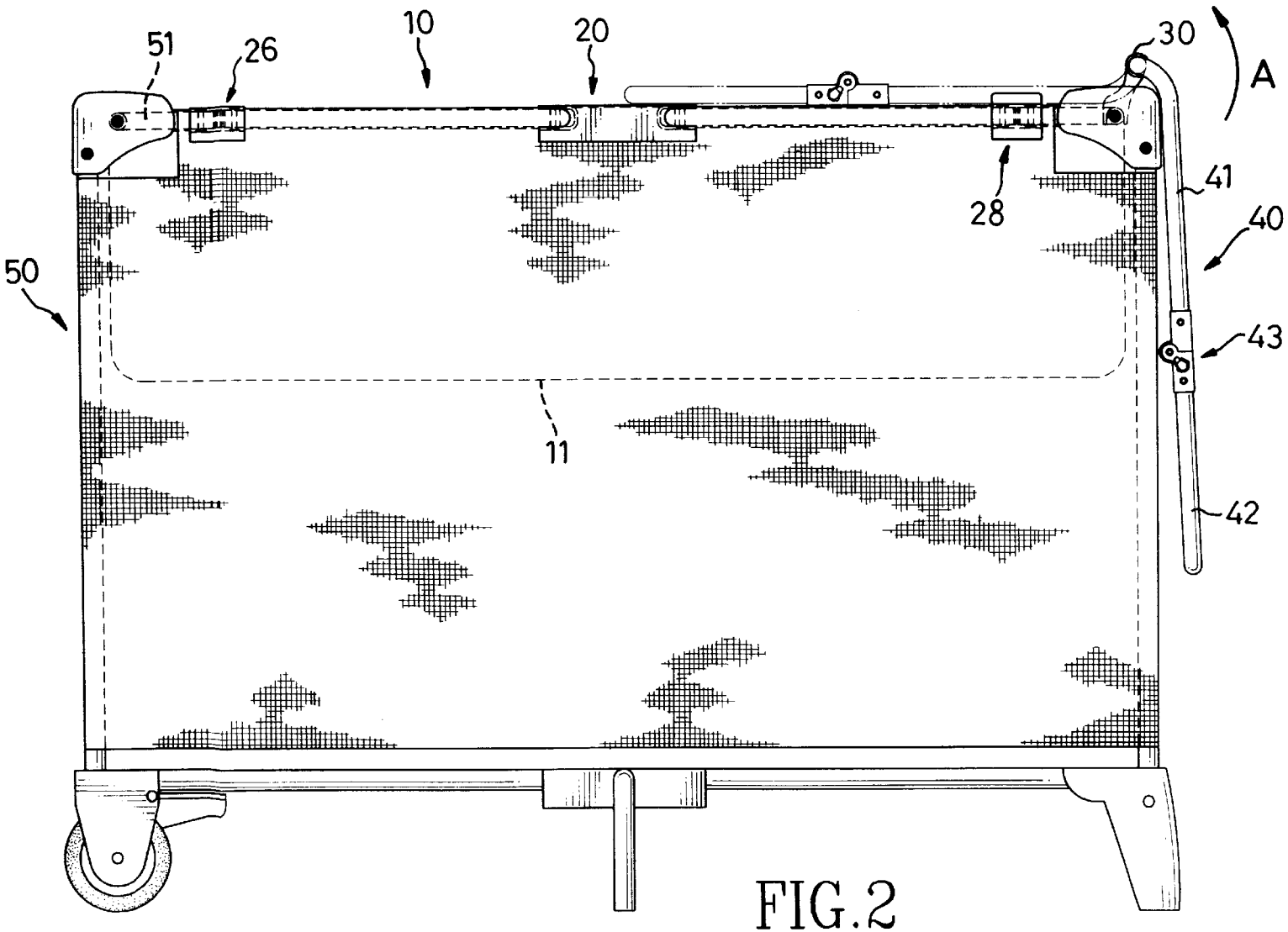
FIG. 2 is a side view showing that a foldable bed is mounted onto a crib.
Figure 3:
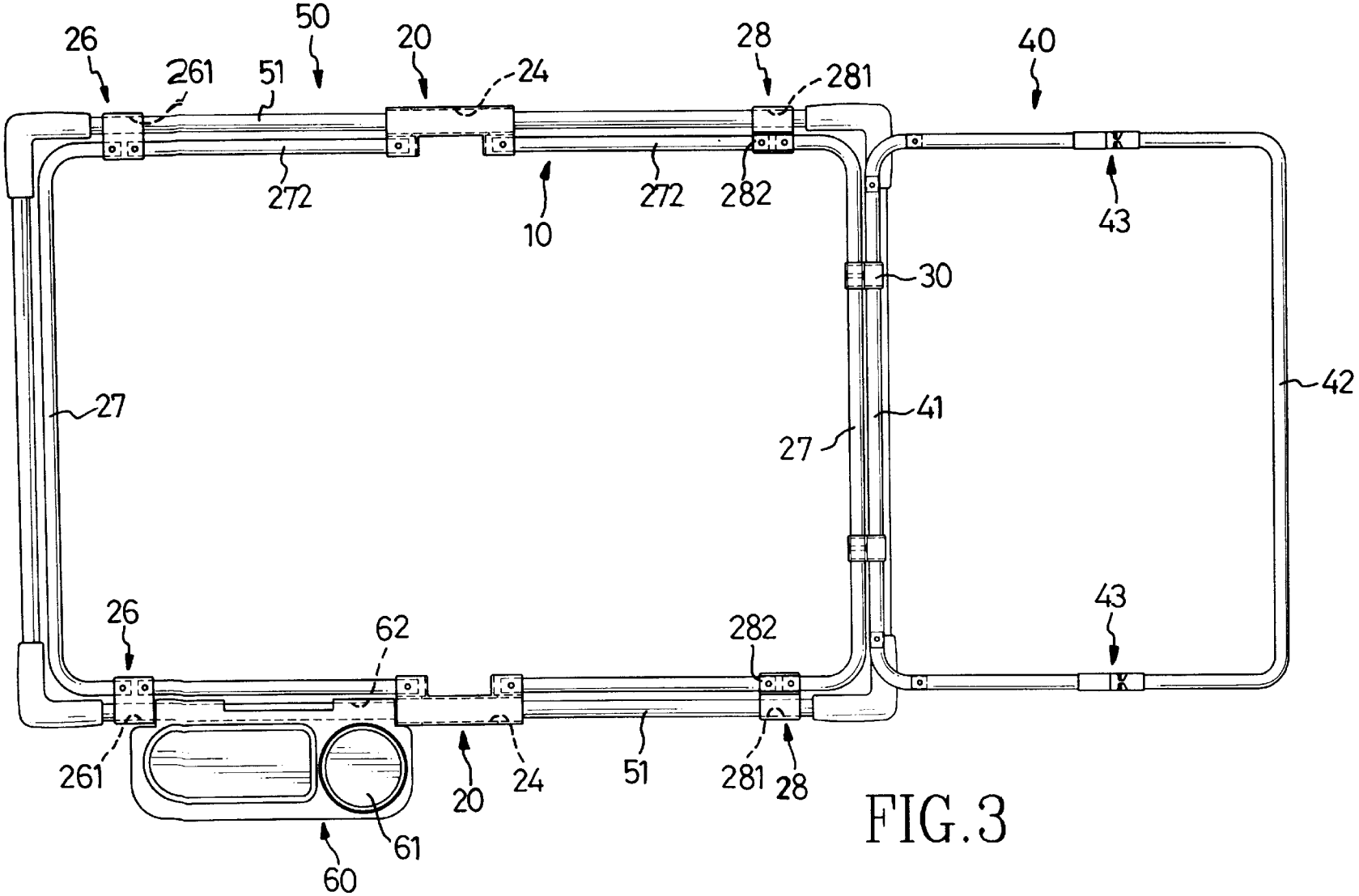
FIG. 3 is a top plane view showing that the foldable bed of the invention is in extended state.

Referring to FIGS. 2 and 3, through the first U shaped recess 261 of the first connector 26, the space 24 of the coupler 20 and the second U shaped recess 281 of the second connector 28, the main frame 40 is able to be mounted onto a top frame 51 of a crib 50.

As shown in FIG. 2, the fabric casing 11 extends downward from the main frame 10 into the crib 50 to provide a base for an occupant to be rested thereon, and the base being substantially higher than a base of the crib 50.

It is notable that the secondary frame 40 usually is rested on one side of the crib 50 and arrow A shows that when the secondary frame 40 is needed, the secondary frame 40 is able to be lifted upward and placed onto the top frame 51 of the crib 50. After the secondary frame 40 is mounted onto the top frame 51 of the crib 50, a parent is able to use the belt 44 to secure the baby to proceed the caring process safely. Furthermore, a bracket 60 mounted onto the top frame 51 defines therein a plurality of receiving spaces 61 for receiving objects, such as a bottle or a cup, thereby facilitating baby's caring process to the parents.

Figure 4:
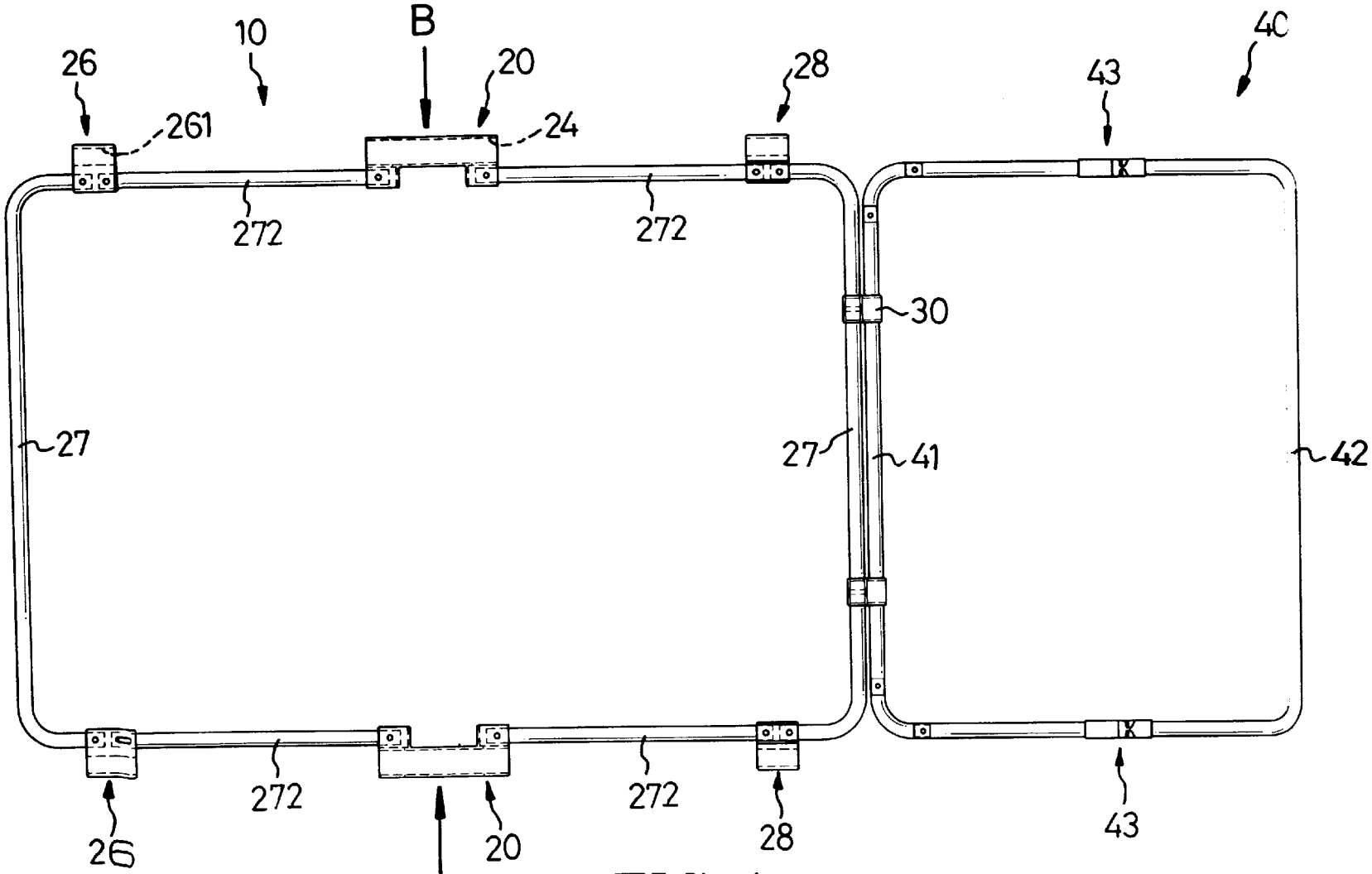
FIG. 4 is a schematic view showing the foldable bed being dismounted from the crib.

When the foldable bed of the invention is not in use, the main frame 10 is firstly removed from the top frame 51 of the crib 50 through the first U shaped recess 261 of the first connector 26, the second U shaped recess 281 of the second connector 28 and the space 24 of the coupler 20. Afterwards, since both distal ends of the legs 272 are respectively connected with the first connector 26 and the coupler 20, the main frame 20 is able to be folded in a mirror image manner by pressing the couplers 20 in a direction as indicated by arrow B, as shown in FIG. 4.

Figure 6:
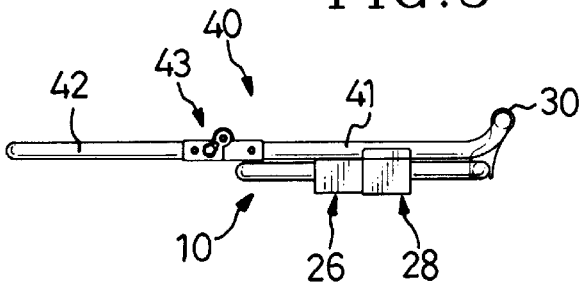
FIG. 6 is a schematic side view showing a folding operation of the foldable bed of the invention.
Figure 7:
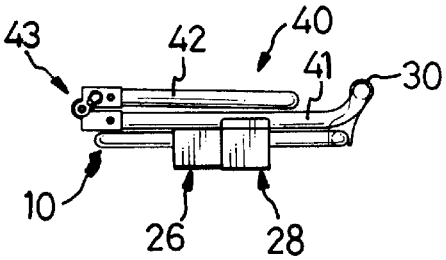
FIG. 7 is a schematic side view showing a further folding operation of the foldable bed of the invention.

FIG. 5 shows that the legs 272 of the main frame 10 are in a folded state. After the legs 272 are folded, the secondary frame 40 is pivoted and rested on top of the folded main frame 10 by means of the joint 30. When the secondary frame 40 is folded as shown in FIG. 6, the secondary frame 40 is able to be further folded by means of the foldable device 43, as shown in FIG. 7, such that when the foldable bed of the invention is no longer needed, the main frame 10 and the secondary frame 40 are able to be folded to minimize the occupied space as much as possible.

From the description, it is shown that the foldable bed for a crib and constructed in accordance with the invention has the following advantages:

1. The foldable bed enables a user to proceed the caring process to a baby with safety;
2. The foldable bed is detachably connected to the crib, such that it is implemented according to the need of the user;
3. The foldable bed is foldable, such that it takes little space when in folded state;
4. The foldable bed provides a surface for the occupant to rest, on which is much more accessible than a lower mat of the crib;
5. The foldable bed provides a platform at a very convenient height for a user to rest a baby on, while a diaper is being changed.

From the foregoing, it is seen that the objects hereinbefore set forth may readily and efficiently be attained, and since certain changes may be made in the above construction and different embodiments of the invention readily without departing from the scope thereof, it is intended that all matter contained in the above description or shown in the accompanying drawings shall be interpreted as illustrative and not in a limiting sense.

What is claimed is:

1. A foldable bed detachably mounted onto a crib comprising:

a main frame detachably mounted onto the crib and having two couplers pivotally connected thereto for folding said main frame in a mirror image manner and at least one joint securely mounted on one side thereof and a fabric casing securely attached thereto; and a second frame pivotally connected with said main frame by means of said joint and having at least two U shaped rods pivotally connected with each other by means of two foldable devices and a fabric mat securely attached thereto.

2. The foldable bed detachably mounted onto a crib as claimed in claim 1, wherein said main frame has:

a pair of first connectors securely connected thereto and having a first recess defined therein;

a pair of second connectors opposingly and securely connected thereto and having a second recess and a third recess defined therein; said third recess being opposed to said second recess and having said secondary frame detachably received therein.

3. The foldable bed detachably mounted onto a crib as claimed in claim 1, wherein said coupler defines therein a space for receiving a portion of the crib and at least two opposed cutouts for providing room to said folding movement of a portion of said main frame.

* * * * *